United States Patent [19]

Chang

[11] Patent Number: 4,747,530

[45] Date of Patent: May 31, 1988

[54] SAFETY PUNCHING DEVICE FOR STAPLE GUN

[76] Inventor: Ted S. Chang, 3f., No.27, Lane 154, Hsing I Road, Pei Tou District, Taipei, Taiwan

[21] Appl. No.: 103,274

[22] Filed: Oct. 1, 1987

[51] Int. Cl.[4] ..... B25C 5/15

[52] U.S. Cl. ..... 227/8; 227/131

[58] Field of Search ..... 227/8, 131

[56] References Cited

U.S. PATENT DOCUMENTS

| | | | |
|---|---|---|---|
| 3,786,978 | 1/1974 | Manganaro | 227/8 |
| 4,298,072 | 11/1981 | Baker et al. | 227/131 X |
| 4,417,681 | 11/1983 | Bernecki et al. | 227/8 |
| 4,573,621 | 3/1986 | Merkator et al. | 227/8 |
| 4,573,624 | 3/1986 | Müller et al. | 227/8 X |

*Primary Examiner*—Paul A. Bell

*Attorney, Agent, or Firm*—Staas & Halsey

[57] ABSTRACT

A safety punching device for staple guns comprising a safety plate extending beyond a staple outlet, a tapered block disposed at the upper end of the safety plate, a horizontal plate contacting with the inclined surface of the tapered block at left end, a pushing block disposed at right end of the horizontal plate to control a safety switch and a resilient sheet engaged with the left end of the horizontal plate to move above-mentioned means back when released. The trigger is pulled and the safety plate is pressed inwardly in order to punch a staple out of the staple gun.

1 Claim, 3 Drawing Sheets

SAFETY PUNCHING DEVICE FOR STAPLE GUN

BACKGROUND OF THE PRESENT INVENTION

Conventional staple guns can be driven by electric power. Referring to FIG. 3, it can be seen that conventional staple guns have a trigger 3 which comprises a protrusion 31. When the trigger 3 is pulled, the protrusion 31 contacts with an operating switch (not shown) to close the electric circuit in the gun body, then a coil 4 can produce a magnetic force to drive a punching plate 5 downward, so that a staple is punched out. Then, a spring 6 restores the punching plate 5 to its original position. It is obvious that the punching plate 5 is so arranged that there is a distance between the punching plate 5 and the front surface of the gun body. Therefore this type of conventional staple gun is difficult to use in a corner. Further, if the trigger 3 is pressed carelessly, the staple can be punched out of the gun which creates a hazard.

It is the purpose of the present invention, therefore, to mitigate and/or obviate the above-mentioned drawbacks in the manner set forth in the detailed description of the preferred embodiment.

SUMMARY OF THE PRESENT INVENTION

It is a main objective of the present invention to provide a safety punching device for staple gun which comprises a safety plate disposed adjacent to a punching plate and extending out of the outlet of the staple so that the safety punching device does not act before the safety plate is moved into the gun body.

It is another objective of the present invention to provide a staple gun with a safety punching device in which the punching plate is disposed adjacent to the front surface of the gun body to reduce the distance therebetween.

Further objectives and advantages of the present invention will become apparant as the following description, and the features of novelty which characterize the invention are pointed out with particularlity in the claims annexed to and forming a part of this invention.

DETAILED DESCRIPTION OF THE PREFERRED EMBODIMENT

Figure 1:
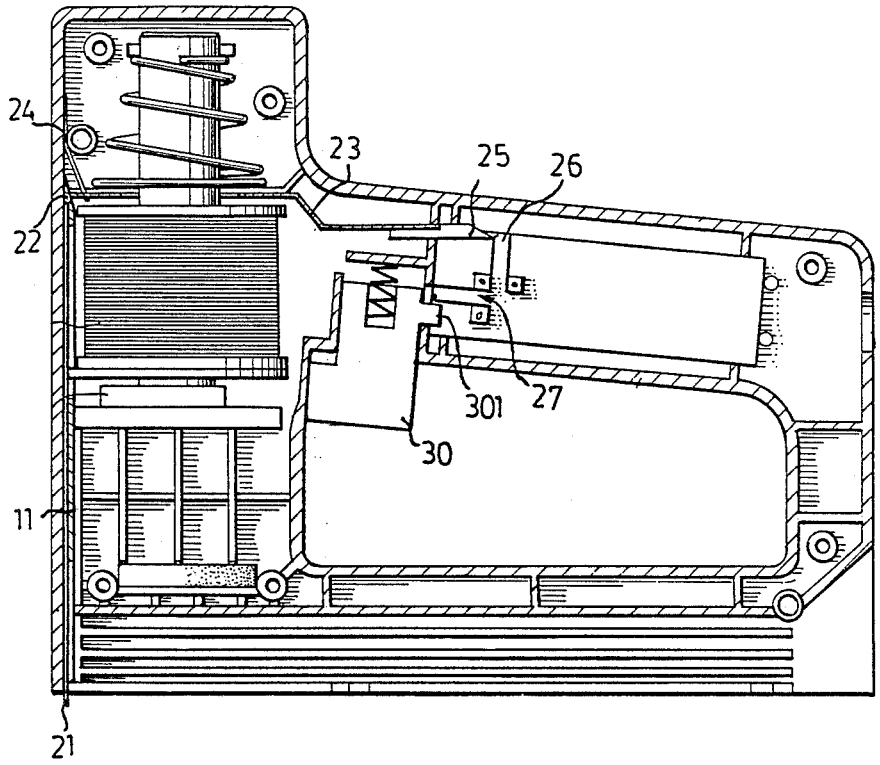
FIG. 1 is a cross-sectional view of a staple gun according to the present invention showing the safety punching device.

Referring to FIG. 1, it can be seen that the gun body of the present invention is the same as that of prior art. A outlet for staple is disposed at the front bottom end of the gun body. A puching plate 11 is arranged adjacent to front surface of the gun body and can pass through the outlet. The distance between the front surface of the gun body and the punching plate 11 is very short so that the staple gun can work at any position.

Figure 2:
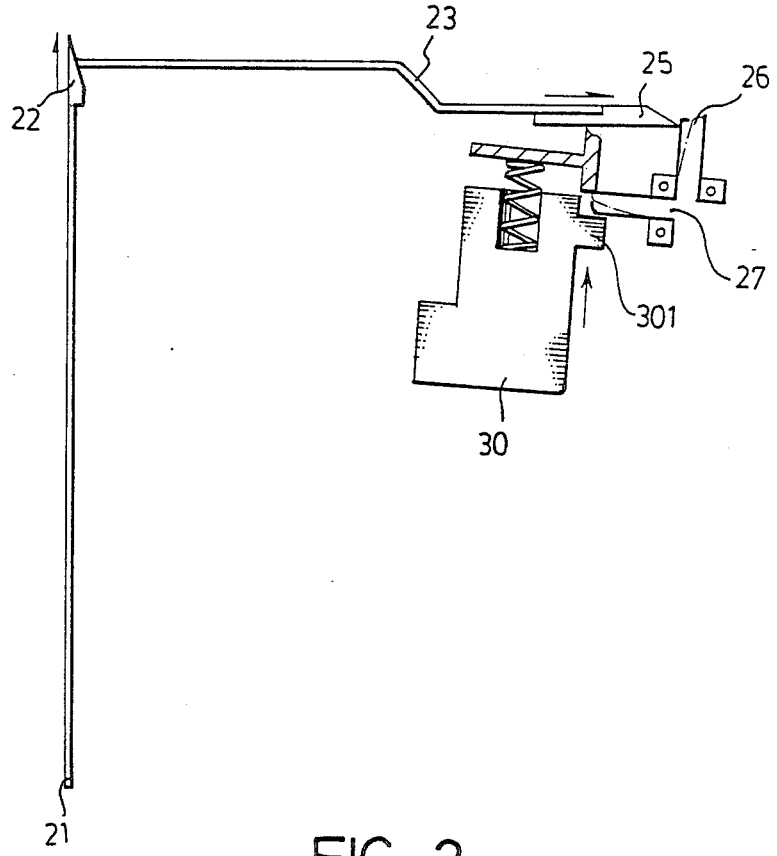
FIG. 2 is a partial view particularly showing the structure of the safety punching device.
Figure 3:
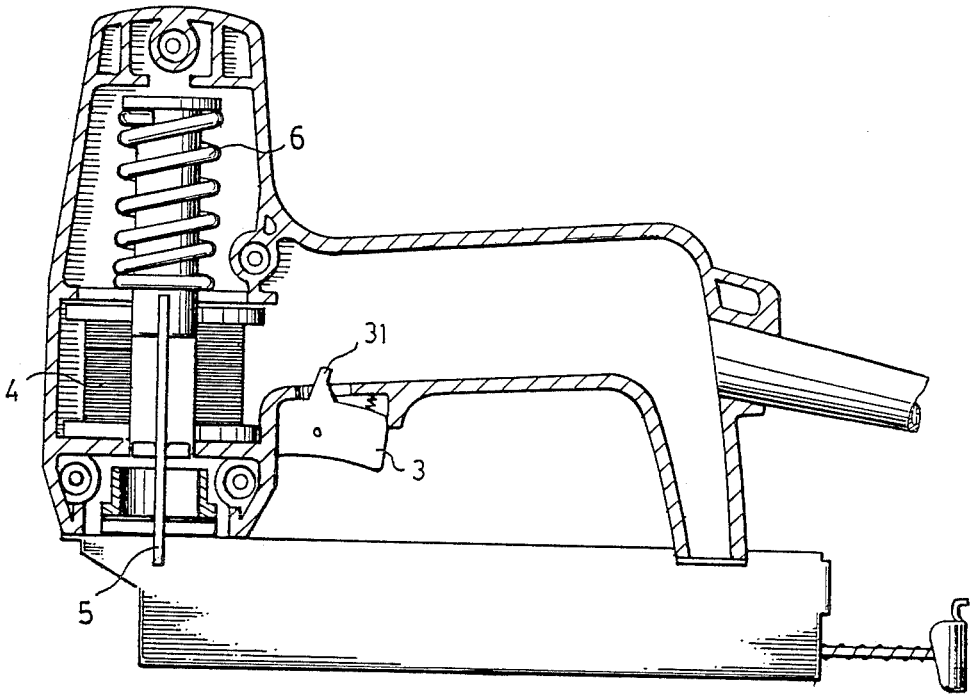
PRIOR ART FIG. 3
FIG. 3 shows a conventional staple gun.

Referring to FIGS. 1 and 2, it can be seen that the safety punching device of the present invention comprises a safety plate 21 which is parallel to the front surface of the gun body, preferably, the safety plate 21 is disposed between the punching plate 11 and the front surface of the gun body. The safety plate 21 normally extends beyond the outlet of the staples. A tapered block 22 is engaged at the upper end of the punching plate 21. A horizontal plate 23 is perpendicular to the safety plate 21. The left end of the horizontal plate 23 contacts the inclined surface of the tapered block 22 and engages with a resilient sheet 24. A pushing block 25 is disposed at the right end of the horizontal plate 21. The pushing block 25 is used to control the "ON" or "OFF" condition of a safety switch 26.

When the trigger 30 is pulled, protrusion 301 puts the operating switch 27 in "ON" condition. Since the safety switch 26 is serially connected to the operating switch 27, only pulling the trigger 30 does not cause the staple gun to activate.

When operating the staple gun, the gun body contacts with a work-piece, that is, the safety plate 21 is pressed in towards the staple gun, then the tapered block 22 which is disposed at the upper end of the safety plate 21 pushes the horizontal plate 23 to move rightward, and then, the pushing block 25 which is disposed at the right end of the horizontal plate 23 turns the safety switch 26 to "ON" condition. If the trigger 30 is pulled, then the staple is punched out. When the staple gun recoils from the work-piece, the resilient sheet 2 will draw the safety punching device back to its original position, that is, the safety switch 26 is in an "OFF" condition, and it is impossible to make a punching action without pulling the trigger 3 and pushing down the pushing block.

As various possible embodiments might be made of the above invention without departing from the scope of the invention, it is to be understood that all matter herein described or shown in the accompanying drawing is to be interpreted as illustrative and not in a limiting sense. Thus, it will be appreciated that the drawings are exemplary of a preferred embodiment of the invention.

I claim:

1. A safety punching device for staple guns comprising:

a safety plate vertically disposed adjacent to a front surface of a gun body, a lower end of the safety plate extending beyond an outlet of said gun body;

a tapered block engaged at an upper end of said safety plate;

a horizontal plate which is perpendicular to said safety plate contacting with the inclined surface of said tapered block at a left end thereof;

a pushing block engaged at right end of said horizontal plate;

a safety switch disposed adjacent to and controlled by said pushing block, the safety switch being serially connected to an operating switch of the gun body; and a resilient sheet engaged with the left end of said horizontal plate when released for restoring the safety punching device to original position.

* * * * *